United States Patent [19]

Winand

[11] 4,304,653

[45] Dec. 8, 1981

[54] DEVICE FOR CONTINUOUSLY ELECTRODEPOSITING WITH HIGH CURRENT DENSITY, A COATING METAL ON A METAL SHEET

[75] Inventor: Rene Winand, Rixensart, Belgium

[73] Assignee: Cockerill, Seraing, Belgium

[21] Appl. No.: 92,739

[22] Filed: Nov. 9, 1979

[30] Foreign Application Priority Data

Nov. 9, 1978 [LU] Luxembourg ..... 80496

[51] Int. Cl.[3] ..... C25D 17/00; C25D 17/10

[52] U.S. Cl. ..... 204/206; 204/211

[58] Field of Search ..... 204/206, 208, 211

[56] References Cited

U.S. PATENT DOCUMENTS

| | | | |
|---|---|---|---|
| 1,437,003 | 11/1922 | Mueller | 204/28 |
| 1,437,030 | 11/1922 | Waters . | |
| 1,819,130 | 8/1931 | Smith . | |
| 2,080,506 | 5/1937 | Rinck et al. . | |
| 2,271,735 | 2/1942 | Hall | 204/206 |
| 2,271,736 | 2/1942 | Hall | 204/237 |
| 2,342,811 | 2/1944 | Martin | 204/206 |
| 2,370,973 | 3/1945 | Lang . | |
| 2,399,964 | 5/1946 | Ward . | |
| 2,461,556 | 2/1949 | Lorig . | |
| 2,509,304 | 5/1950 | Klein . | |
| 2,569,577 | 10/1951 | Reading . | |
| 2,899,445 | 8/1959 | Rosen . | |
| 3,975,242 | 8/1969 | Matsuda et al. . | |

FOREIGN PATENT DOCUMENTS

| | | | |
|---|---|---|---|
| 1386165 | 3/1964 | France | 204/208 |
| 1510512 | 2/1967 | France . | |
| 49-123131 | 11/1974 | Japan . | |

*Primary Examiner*—T. M. Tufariello

*Attorney, Agent, or Firm*—Browdy and Neimark

[57] ABSTRACT

There is described a method for continuously electrodepositing with high current density, a coating metal on a metal sheet, which comprises moving by means of a movable cathode the metal sheet pressed thereagainst, in front of an anode inside a zone that comprises an electrolyte for transferring the coating metal, in which the cathode current is distributed uniformly over that portion of the metal sheet which moves in the area for metal transfer to the cathode in such a way as to cause a current density which is substantially equal in every point of said sheet portion.

21 Claims, 5 Drawing Figures

DEVICE FOR CONTINUOUSLY ELECTRODEPOSITING WITH HIGH CURRENT DENSITY, A COATING METAL ON A METAL SHEET

This invention has for object a method for continuously electrodepositing with high current density, a coating metal on a metal sheet, which comprises moving by means of a movable cathode the metal sheet pressed threagainst, in front of an anode inside a zone that comprises an electrolyte for transferring the coating metal.

Various methods and devices are already known for continuously coating a metal sheet with a coating metal.

For instance a U.S. Pat. No. 1,437,030 pertains to an electrolysis cell which uses an insoluble anode for coating a metal sheet.

U.S. Pat. No. 1,819,130 discloses a complete surface-treatment line. Two superimposed sheets comprise the cathode in the electrolysis cell and three rollers insure accurate guiding of said sheet inside the cell.

U.S. Pat. No. 2,080,506 pertains to high current density galvanizing. It discloses the coating of a wire in an acid solution of zinc sulphate. An improved material transfer is obtained due to forced flow of the electrolyte. This is the main feature of an electrolysis cell as described and shown in U.S. Pat. No. 2,370,973.

U.S. Pat. No. 2,399,964 pertains to a galvanizing line which comprises a series of vertical stacked cells. The metal sheet is coated therein on one side only. The coating thickness is uniformized by means of anodic dissolving after the depositing operation.

U.S. Pat. No. 2,461,556 mentions an electrolysis cell in which the metal sheets are coated on both sides thereof in two operations, within the same cell.

U.S. Pat. No. 2,509,304 pertains to an electrolysis cell which is comprised of a large number of tanks which are arranged at different heights and which let the electrolyte flow by gravity from one tank to another.

U.S. Pat. No. 2,569,577 mentions the distributing of that metal deposited over a substrate and proposes adding electrolyte in the center of the electrolysis tank.

In the U.S. Pat. No. 2,899,445 is provided the use of a curved conductor to support the metal sheet inside the electrolysis tank to deposit metal but on the one sheet surface.

U.S. Pat. No. 3,975,242 provides a horizontal and straight galvanizing cell which can be adapted to varying sheet widths and in which occurs a forced flow of the electrolyte.

Japanese Pat. No. 123,131 describes the electro-galvanizing under high current density by means of a soluble electrode from zinc.

French Pat. No. 1,510,512 and U.S. Pat. No. 3,483,113 propose several types from electrolysis cells for galvanizing which allow to use high current densities by means of an insoluble anode.

All of the above known methods and cells for electrolysis have various drawbacks, particularly so when it is desired to perform an electrolysis with high current density and continuously to coat the one surface of a sheet with a coating metal such as zinc.

Indeed it has been noticed up to now that when using an electrolysis with high current density, it is not possible to obtain an uniform mass transfer at the cathode, and there results the formation of an irregular coating with an unsatisfactory quality.

An essential object of the invention is to provide a method which obviates said drawback.

For this purpose according to the invention, the cathode current is distributed uniformly over that portion of the metal sheet which moves in the area for metal transfer to the cathode in such a way as to cause a current density which is substantially equal in every point of said sheet portion.

The invention also pertains to a device for electrodepositing continuously and under high current density, a coating material on a metal sheet, notably for the working of the above-defined method, and which device further comprises a functional electrolysis cell suitable for use at an industrial scale with very high efficiency.

The device according to the invention comprises a fixed anode and a movable cathode, said cathode cooperating with a cathodic current supply and having an electrically-conducting wall which is movable with a substantially constant spacing relative to the anode inside a zone where can flow an electrolyte for transferring a coating metal to the sheet, means being provided to apply in said zone, the sheet to be coated against that surface of said conducting wall which faces the anode and to drive said sheet at the same speed than said electrically-conducting wall.

Said device is characterized by the fact that the cathodic current supply comprises a series of contacts which are connected in parallel and distributed substantially uniformly over that surface of said conducting wall removed from the surface the sheet is applied against.

Advantageously said contacts are comprised of current-feeding brushes which engage that surface of the conducting wall which is removed from the surface the sheet is applied against.

In a preferred embodiment of the invention, the electrically-conducting wall is comprised of an endless belt trained about two rollers which rotate about the axis thereof.

Finally the invention further relates to a metal sheet which has been coated over one surface thereof at least with a metal layer which is obtained according to the method or by means of the device for electrolysis according to the invention.

Other details and features of the invention will stand out from the description given below by way of non limitative example and with reference to the accompanying drawings, in which.

In the various figures, the same reference numerals pertain to similar elements.

Figure 1:
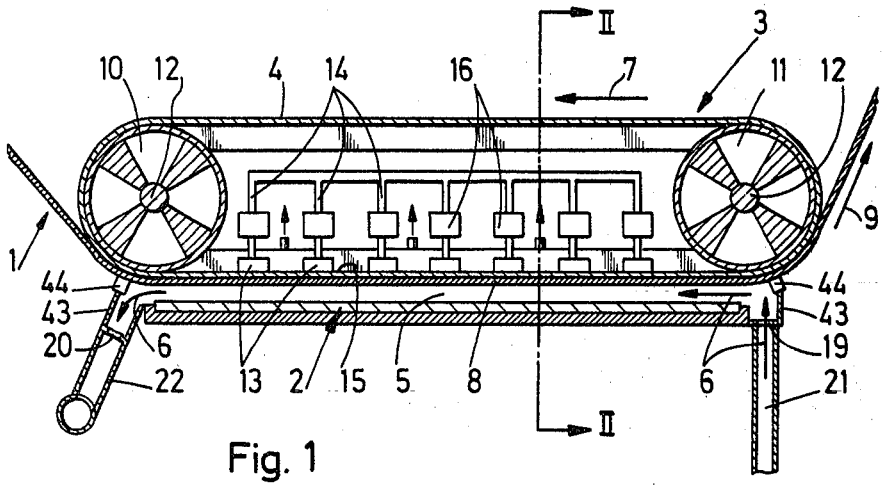
FIG. 1 is a diagrammatic elevation view with lengthwise cross-section along line I—I in FIG. 2, of an electrolysis device according to the invention.

The invention relates to a method for electrodepositing continuously and under high current density, a coating metal such as zinc or tin on a metal sheet.

According to such method, by means of a movable cathode, a metal sheet applied against said cathode is moved past an anode inside a zone that comprises an electrolyte for transferring the coating metal.

An essential feature of the above method is the distributing of the cathodic current substantially uniformly over that sheet portion which moves inside said area, in such a way as to cause a current density which is substantially equal in every point of said sheet portion.

It has indeed been noticed that it is essential to obtain an uniform distribution of the current in all of the sheet portion on which the metal is electrodeposited, as soon as some electric current density is obtained, to have a metal coating on said sheet with a substantially constant thickness and a finish which meets the present industrial requirements.

Moreover to insure a perfect homogeneity in the cathodic coating on the metal sheet, the electrolyte is caused to flow with a turbulent rate and under pressure between the anode and that sheet portion which moves through said area, to apply therein said sheet strongly against the movable cathode and thus minimize the differentials in the voltage drops between the cathode and the sheet in various locations and also to retain a substantially constant spacing between the sheet and the anode in every point in said transfer zone. It has been noted that this is a very simple solution which is however very efficient for the intended purpose.

To minimize the absolute speed of the movable cathode and the electrolyte, said electrolyte is caused to flow in the transfer zone in a direction which is opposed to the movable cathode direction. This does further contribute to generate in every point of said zone substantially the same transfer conditions for the coating metal towards the sheet and thus to insure a constant thickness for the metal layer on said sheet.

Depending on the nature of the metal or on the structure of the electrolysis device used, the anode can be comprised of the coating metal which is soluble in the electrolyte or be made from an indifferent material, the coating metal in this case being first brought in solution in the electrolyte.

Advantageously the cathode receives a current density of at least 50 amperes per $dm^2$ and preferably at least 100 amperes per $dm^2$.

On the other hand, the electrolyte is circulated in the metal-transfer zone with a relative speed to the metal sheet in the range of 4 m. per second.

Some practical examples of embodiment of the method according to the invention are given hereinafter.

In the case of zinc, the soluble anode was comprised of a block from Special High Grade zinc. The cathode used was made from mild steel and the spacing between the anode and cathode was about 6 mm. The electrolyte had a relative speed of 4 m/sec. The electrolyte temperature was 50° C. with a concentration in $Zn^{++}$ of 80 g/l. The thickness of the zinc coating obtained was 10 microns.

With the above-defined parameters, the density of the cathode current cas caused to vary between 50 and 300 ampres per $dm^2$. The results obtained are given in the following Table.

| Current density | Current efficiencies | |
|---|---|---|
| | cathode | anode |
| 50 $A/dm^2$ | 95% | 101% |
| 100 $A/dm^2$ | 95% | 101% |
| 200 $A/dm^2$ | 95% | 100% |
| 300 $A/dm^2$ | 95% | 100% |

In the case of tin, the soluble anode was comprised of a block from pure tin, the cathode used was made from mild steel and the spacing between anode and cathode was about 6 mm. The electrolyte had a relative speed of 4 m/sec., the electrolyte temperature was 50° C. and the concentration in $Sn^{++}$ was 27 g/l.

The thickness of the tin coating obtained was 10 microns. The results obtained are given in the following Table.

| Current density | Current efficiencies | |
|---|---|---|
| | cathode | anode |
| 50 $A/dm^2$ | 100% | 104% |
| 100 $A/dm^2$ | 100% | 102% |
| 200 $A/dm^2$ | 100% | 102% |
| 300 $A/dm^2$ | 100% | 101% |

The object of the invention will be further illustrated by the following description of a few variations of an electrolysis device according to the invention, which can be used for the working of the above-defined method.

Figure 2:
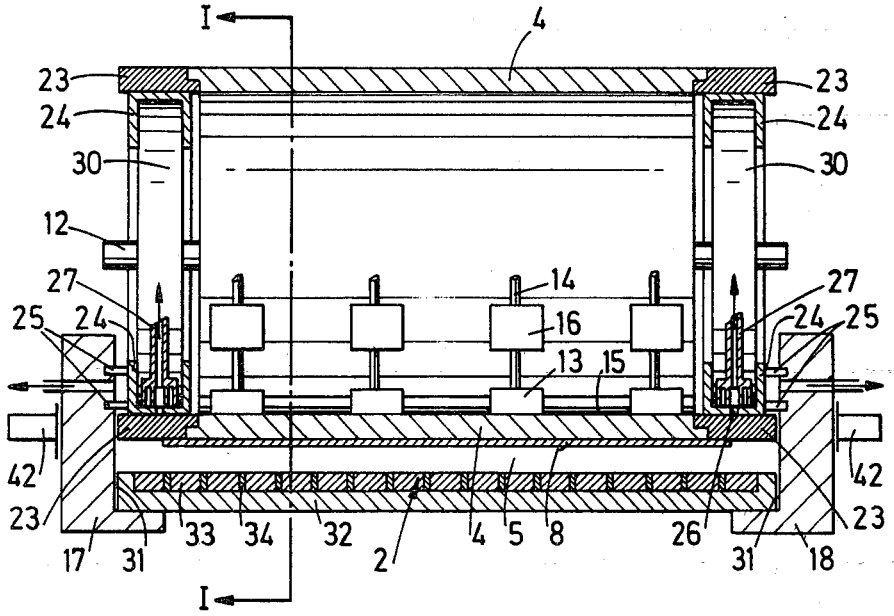
FIG. 2 is a cross-section along line II—II in FIG. 1, on a larger scale.

FIGS. 1 and 2 show a device for electrode-positing continuously under high current density, a coating metal on a metal sheet 1.

Said device comprises a fixed anode 2 and a movable cathode 3. The movable cathode has an electrically-conducting wall which is comprised of an endless belt 4 which is movable at a substantially constant spacing from anode 2 inside a zone 5 of constant thickness in which can flow an electrolyte along the direction as shown by arrows 6, to transfer a coating metal such as zinc, to the sheet. The endless belt 4 moves in the direction shown by arrow 7. The belt drive can be insured for instance directly by the friction against that sheet portion 8 which is pulled through transfer zone 5 in the direction shown by arrow 9. Said metal sheet may for instance be unrolled continuously from a coil thereof not shown on the left-hand side of FIG. 1, to be wound therafter, after passing through zone 5, on another coil not shown either on the right-hand side in FIG. 1. In such a case the endless belt is tensioned about two rollers 10 and 11 which rotate freely about the axis 12 thereof.

The conveying belt 4 cooperates with a cathodic current supply that comprises a series of contacts such as brushes 13 connected in parallel on brush-holders 14 and which are distributed substantially uniformly over that surface 15 of belt 4 which is opposed to the one the sheet 1 is applied against.

Means shown in 16, such as mechanical, hydraulic or pneumatic means known per se, can be provided for each brush 13 to allow adjusting the pressure thereof against surface 15 of belt 4, independently from one another and according to the current strength.

Said brushes are preferably made from Cu-C, but of course other suitable materials could be considered.

The endless belt can be made from a Cu-Be-Ag alloy, other alloys might however be considered.

Contacts not shown in the figures, might be mounted in a way similar to brushes 13, inside rollers 10 and 11 on the side of sheet portion 8 to enlarge as far as possible that sheet area which is subjected to the coating in the transfer zone 5.

Said transfer zone 5 is bounded substantially tightly relative to the electrolyte by that sheet portion 8 which engages endless belt 4, the anode 2 which extends facing said sheet portion 8 and side-plates 17 and 18 which extend on either side of the corresponding side edges of endless belt 4 and anode 4. An electrolyte inlet 19 to said transfer zone 5 is provided adjacent that location where the sheet 1 leaves the belt 4, while an electrolyte outlet 20 from said zone is provided adjacent the opposite anode end.

Inlet 19 and outlet 20 for the electrolyte are connected to a tank not shown, through pipes 21 and 22 respectively.

As shown in FIG. 2, the side edges of endless belt 4 are provided with rims 23 from an electrically-insulating material which is substantially resilient, rims against which are substantially tightly applied the corresponding edges of the sheet portion that cooperates with belt 4 inside transfer zone 5.

Endless belts 24 which are also made from a substantially resilient electrically-insulating material, are applied against those surfaces of rims 23 which are opposed to the surfaces cooperating with sheet portion 8 and move at the same speed as said rims 23.

Seals 25 are provided between said belts 24 and the corresponding side-plates 17 and 18.

To prevent a possible electrolyte leak between the conveying belt 4 and the rims 23 towards surface 15 of the conveying belt 4 on which slide the brushes 13, perforations 26 are provided in that portion of the belts which engages rims 23 and suction members 27 are mounted on the inner surface thereof, on that belt side removed from rims 23. Said members 27 are stationary, bear on the belts and are for instance connected to a suction pump not shown, which allows recirculating the electrolyte from the possible leaks to said tank.

The side-plates 17 and 18 are provided facing belts 24, with similar suction members which comprise small ducts 29 passing through the plates, said ducts 29 also being connected to said suction pump to recycle the electrolyte from possible leaks at seals 25 between side-plates 17 and 18 and the belts 24.

Said belts 24 pass about pulleys 30 with the same diameter as rollers 10 and 11 and mounted on the free ends of roller shaft 12 on either side of said rollers.

In the embodiment as shown in the figures, the belts have a cross-section of U-shape the flanges of which extend against the side surfaces of said pulleys 30.

However said belts of U-shape could be replaced by belts of heavier thickness and with a rectangular cross-section, which are provided for instance on that surface which will cooperate with the pulley, with one or more lengthwise ribs which enter corresponding grooves provided in the pulley cylindrical surface. A belt with an L-shaped cross-section the one leg of which engages the outer side surface of the pulleys could also be suitable.

To insure the sealing between side-plates 17 and 18 and the support 32 fo the fixed anode 2, it is possible to provide between the side-plates and the support sealing joints 31. As same are joints arranged between two stationary parts, no sealing problem will be encountered there.

The anode 2 is for example comprised of a series of parallel rods 33 spaced from one another by joints 34 from insulating material. Separate anode current feeds for each rod or rod group connected in parallel, are provided for instance to insure for the anode also a substantially uniform distribution of the electrolysis current through the electrolyte flowing through the transfer zone 5.

Figure 3:
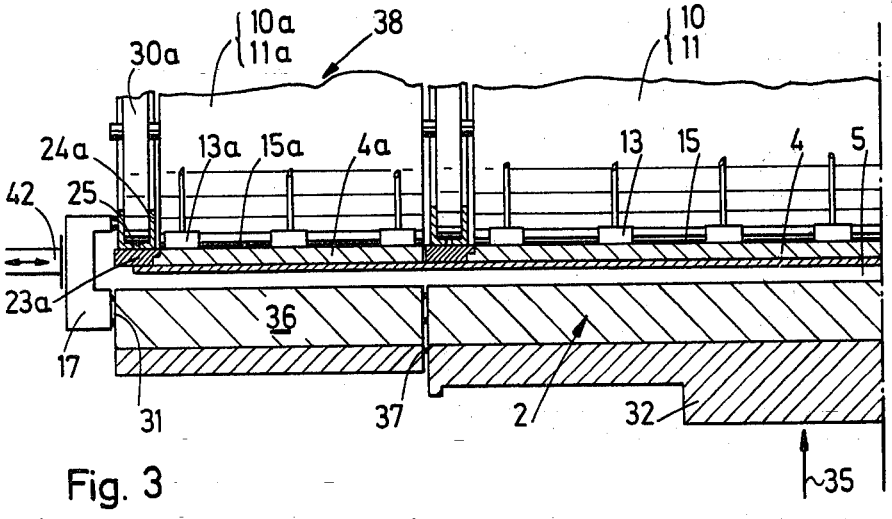
FIG. 3 is a cross-section similar to FIG. 1, of a variation of an electrolysis device according to the invention.
Figure 4:
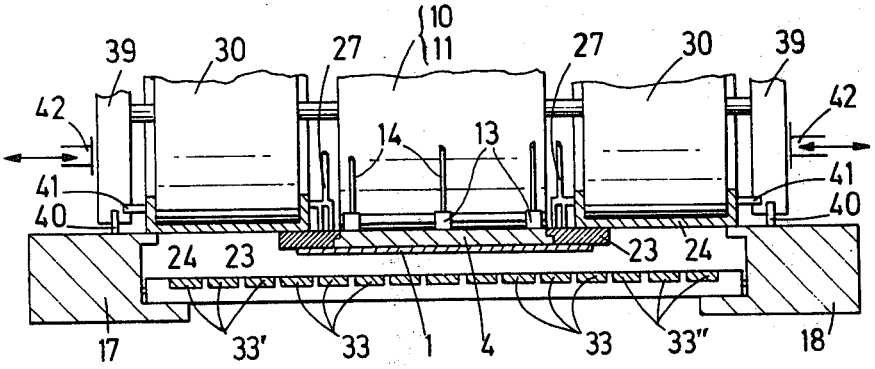
FIG. 4 is also a similar cross-section of another variation of an electrolysis device according to the invention.
Figure 5:
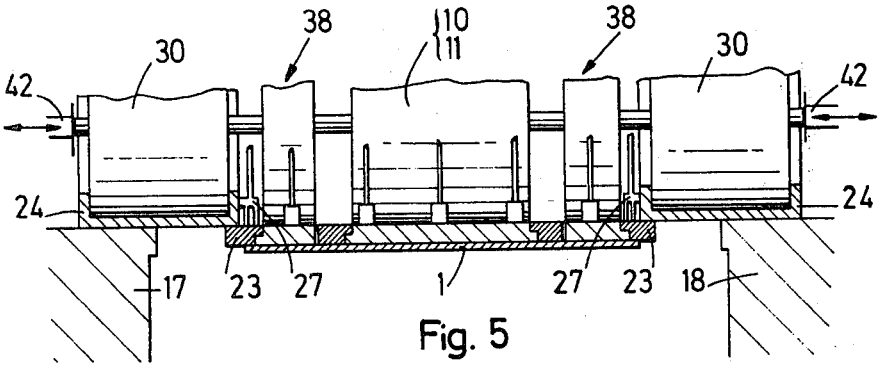
FIG. 5 is a cross-section of a variation similar to the one shown in FIG. 4, completed with cathode elements.

FIGS. 3 to 5 pertain to other variations of the electrolysis device according to the invention, which have mostly the advantage of allowing the continuous treatement of metal sheets with varying width.

FIG. 3 shows the case of electrolytic coating of a sheet 1 by means of a soluble anode 2, that is an anode comprised of a block from the metal to be deposited on the sheet.

Said anode is mounted on a support 32 which is movable towards the cathode as shown by arrow 35 according to the consumption thereof, in such a way as to retain a substantially constant spacing between the top block surface and the sheet.

The anode width can be adjusted according to the width of metal sheet 1 to be coated by adding additional blocks 36 which are separated from one another by joints 37 from electrically-insulating material.

To vary the width of the movable cathode 3 according to the width of the sheet 1 to be treated, use is made of discrete elements which each comprise an endless belt **4*a* the outer side surface at least of which is provided with a rim 23*a* from a substantially resilient, electrically-insulating material, rollers 10*a* and 11*a* having the same diameter as the corresponding rollers 10 and 11 in FIGS. 1 and 2, and a belt 24 also from electrically-insulating material which is mounted on pulleys 30*a* and cooperates with rim 23*a***.

By means of a suitable mechanism, for instance with slideway not shown in the figures, it is possible to provide for a very easy assembly and disassembly of said discrete cathode elements 38.

In each cathode element 38 contacts for instance in the shape of brushes **13*a*, are mounted and distributed in the same way as the contacts 13 cooperating by sliding with surface 15 of endless belt 4**.

The sealing means and other components of the electrolysis device as shown in FIG. 3 correspond to the ones already described in relation with FIGS. 1 and 2.

FIGS. 4 and 5 pertain to other variations of the electrolysis device according to the invention. They differ from the variation as shown in FIG. 3 essentially by the use of an insoluble anode of the same type as the anode shown in FIGS. 1 and 2 and in the sealing between side-plates 17 and 18, belts 24 and rims 23 from belt 4 being obtained in a somewhat different way.

As the anode 2 covers the maximum width allowable for the electrolysis device, means are provided to feed electric current but to those rods which extend facing the sheet to be treated. For instance, rods 33' and 33'' are not energized to treat the sheet shown in FIG. 4.

The width of the pulleys extending on either side of rollers 10 and 11 is substantially larger than the width of the pulleys in the embodiments shown in the FIGS. 1 to 3. As it may be noted, said pulleys drive belts 24 that bear partly on rim 23 of endless belt 4 and partly on the top surface of side-plates 17 and 18 which are completely stationary in this embodiment, independently from the width of that sheet 1 to be treated.

According to the variation in the width of said metal sheet, that portion of the belt bearing on the side-plates also varies. This is quite clear from FIG. 5 in which has been shown an electrolysis device similar to the device as shown in FIG. 4, in which however a cathode element 38 has been added on either side of rollers 10 and 11. Said elements 38 have thus been sandwiched between rollers 10 and 11 and the wider pulleys 30. Consequently they are not provided with an additional belt.

To treat a sheet 1 with the minimum width, the surface of belts 24 contacting the side-plates 17 and 18 can be very small in such a way that it might be advantageous to provide additional sealing means between a side-plate and the corresponding belt. Said means might for example be comprised of a support 39 for fixed joints 40 and 41 which cooperate respectively with the side-plates 17 and 18 and the belts 24.

The suction means 27 are arranged in the embodiments as shown in FIGS. 4 and 5, outside of the belts 24 on the side of rollers 10 and 11 and they slide against the rims 23 from belt 4 which are made from electrically-insulating material. Such types of suction members might of course also be provided in the embodiments as shown in FIGS. 1 to 3.

Also in relation with the embodiments as shown in FIGS. 1 and 3, there might also advantageously be provided a mechanism shown diagrammatically in 42, which allows pressing the side-plates against the anode and the belts 24 to insure the required sealing with joints 25 and 31. Said mechanism can be operated magnetically, hydraulically or pneumatically and it can move along a direction substantially in parallel relationship with a straight line lying in the sheet surface at right angle to the sheet movement direction.

Finally it is of importance to provide between the end walls 43 which bound cross-wise the transfer zone 5 underneath rollers 10 and 11, sealing joints 44 which bear against the metal sheet entering and leaving said transfer zone 5.

It is to be noted that due to the very particular design of the electrolysis device according to the invention, that sheet surface removed from the surface to be coated with a metal remains completely untouched, which results in the possible following treatment of said uncoated surface being strictly minimized.

This is particularly due to the sealing efficiency between the transfer zone 5 and said uncoated sheet surface, which is obtained mainly due to the pressure exerted by the electrolyte on the sheet portion 8 which moves through transfer zone 5.

It is moreover to be noted that to the exception of the joints 44, there is no sliding of a sealing joint on metal parts.

Means not shown in the figures may be provided to tension continuously the endless belt to have that belt portion against which bears the metal sheet passing through transfer zone 5, move inside a substantially horizontal plane at a constant distance from the anode. The provision of the brushes 13 bearing on the belt inner surface 15 as well as the inner surface of the belts 24 also insures a guiding action which allows to enhance such horizontal arrangement.

It is however to be noted that when insoluble anodes only are used, in some cases, it would be possible to substitute to conveying belt 4 and both rollers 10 and 11, a single hollow drum with a larger diameter inside which would be provided contacts such as brushes, uniformly distributed over that inner cylindrical drum surface which is opposed to the surface against which would then bear the metal sheet passing through the zone for transferring the coating metal. The anode would then be of curved shape.

It must be understood that the invention is not limited to the above embodiments and that many changes can be brought therein without departing from the scope of the invention as defined in the appended claims.

For instance when it is desired to coat both sides of a metal sheet, it will only be required to provide two electrolysis devices as described above in series arrangement to coat in sequence both sheet surfaces.

The brushes could possibly be replaced by other means which allow insuring an uniform current distribution over that sheet portion which moves past the anode.

For sheets intended for some particular applications or for some types of sheets, it would be possible to dispense with the conveying belt 4 rotating about rollers 10 and 11. In such a case the sheet edges would bear directly on the outer surface of the belts and the contacts for feeding the cathode current would bear directly on that sheet surface which is not to be coated with a metal layer. Said conducting wall would thus be formed in such a case by sheet portion 8 itself.

I claim:

1. Device for continuously electro-depositing, under high current density, a coating metal on a metal sheet, comprising a substantially horizontal plane fixed anode and a movable cathode, said cathode cooperating with a carthodic current supply and having an electrically-conducting wall which is movable with a substantially constant spacing relative to the anode inside a zone where can flow an electrolyte in substantially the same direction through the entire transfer zone between the anode and the cathode and substantially in a parallel direction to the anode for transferring a coating metal to the sheet, an electrolyte inlet at one end and an electrolyte outlet at the opposite end of said zone, the cathodic current supply comprising a series of contacts which are connected in parallel and distributed substantially uniform over the surface of said conducting wall removed from its surface facing the anode.

2. Device as defined in claim 1, in which said contacts are comprised of current-feeding brushes which engage that surface of the conducting wall which is removed from the surface the sheet is applied against.

3. Device as defined in claim 2, in which the brushes are adjustably applied against said cathode wall surface according to the current strength.

4. Device as defined in claim 1, in which the electrically-conducting wall is comprised of an endless belt trained about two rollers which rotate about the axis thereof.

5. Device as defined in claim 4, in which said transfer zone is bounded substantially tightly to the electrolyte by that sheet portion which bears against the endless belt, the anode extending facing said sheet portion and side-plates which extend on either side of the corresponding side edges of the endless belt and the anode, an electrolyte inlet to said transfer zone being provided adjacent that anode end lying in the location where the sheet leaves said belt, and an electrolyte outlet from said zone being provided adjacent the opposite anode end.

6. Device as defined in claim 4, in which the endless belt sides are provided with rims from relatively resilient, electrically-insulating material against which bear substantially tightly, the corresponding edges from that sheet portion which cooperates with the belt in said transfer zone.

7. Device as defined in claim 6, which comprises on the one hand, endless belts also from a substantially resilient, electrically-insulating material, which bear against said rim surfaces from a substantially resilient, electrically-insulating material opposed to those surfaces cooperating with said sheet and moving at the same speed as said rims and on the other hand, sealing joints provided between the belts and the corresponding side-plates.

8. Device as defined in claim 7, in which suction members are provided to recover and recycle the electrolyte from possible leaks at the joints on the one hand between the belts and the rims from said endless belt, and on the other hand between the belts and the side-plates.

9. Devices as defined in claim 7, in which the belts pass over pulleys which are co-axial with the rollers and arranged on either side thereof.

10. Device as defined in claim 1, which further comprises separate cathode elements which can be mounted sidewise relative to one another to cover metal sheets having varying widths, said elements also comprising an electrically-conducting movable wall and parallel-mounted contacts which are distributed substantially uniformly over that wall surface opposed to the surface cooperating with said sheet.

11. Device as defined in claim 10, in which said cathode elements each comprise an endless belt the outer side of which at least is provided with a rim from substantially resilient, electrically-insulating material, and a belt also from electrically-insulating material trained over pulleys and cooperating with said rim.

12. Device as defined in claim 1, in which the anode is comprised of insoluble rods substantially in parallel relationship which are spaced from one another by joints from electrically-insulating material, means being provided to adjust the number of energized rods according to the width of the metal sheet to be coated.

13. Device as defined in claim 1, in which the anode is soluble and made of blocks from the metal to be deposited on the sheet to be coated, said blocks being mounted in a support allowing moving same towards the cathode according to the block consumption, means being provided to adjust the anode width according to the width of the sheet to be coated by adding additional blocks from said metal which are spaced from one another by joints from electrically-insulating material.

14. Device as defined in claim 5, in which said side-plates are mounted on a mechanism allowing to move said plates along a direction substantially in parallel relationship with a straight line lying in the sheet surface at right angle to the sheet movement direction and to press said plates against said anode and cathode independently from the width thereof.

15. Metal sheet coated with a metal layer in the device as defined in claim 1.

16. Device as defined in claim 1, further comprising means to apply the sheet to be coated in said zone against that surface of said conducting wall which faces the anode and to drive said sheet at the same speed as said electrically-conducting wall.

17. Device for continuously electrodepositing, under high current density, a coating metal on a metal sheet, comprising an elongated fixed anode having a substantially horizontal face;

a movable cathode having an electrically-conducting wall movable with a substantially constant spacing relative to said horizontal face of said elongated fixed anode, an elongated zone of substantially constant thickness being defined between said substantially horizonatl face of said fixed anode and said electrically-conducting wall of said movable cathode, said zone having first and second ends;

means to flow an electrolyte in substantially a single direction through the zone of substantially constant thickness between said face of said fixed anode and said electrically conducting wall of said movable cathode, whereby the direction of flow of the elecrolyte is substantially parallel to said face of said fixed anode from one end of said zone to the other end thereof;

means for feeding a metal sheet through the zone and in contact with said electrically-conducting wall of said movable cathode; and means for supplying said movable cathode with current, said means comprising a series of contacts connected in parallel and distributed substantially uniformly against a wall of said movable cathode which is opposite said electrically-conducting wall.

18. Device as defined in claim 17, wherein said means for supplying said movable cathode with current comprises means to provide a current density of at least 30 $A/dm^2$.

19. Device as defined in claim 17, wherein said means to flow said electrolyte through the zone of constant thickness comprises a means to circulate elecrolyte through such zone at a rate of approximately 4 m/sec. relative to the rate of movement of the metal sheet to be coated.

20. Device as defined in claim 17, wherein said series of contacts are made from Cu-C.

21. Device as defined in claim 17, wherein said movable cathode is an endless belt made from a Cu-Be-Ag alloy.

* * * * *